175-48

5/11/76 XR 3,955,411

United States Patent [19]

Lawson, Jr.

[11] 3,955,411

[45] May 11, 1976

[54] METHOD FOR MEASURING THE VERTICAL HEIGHT AND/OR DENSITY OF DRILLING FLUID COLUMNS

[75] Inventor: Ernest E. Lawson, Jr., Houston, Tex.

[73] Assignee: Exxon Production Research Company, Houston, Tex.

[22] Filed: May 10, 1974

[21] Appl. No.: 469,139

[52] U.S. Cl. ..... 73/155; 175/7; 175/48

[51] Int. Cl.[2] ..... E21B 47/04

[58] Field of Search ..... 73/151, 152, 155, 439, 73/302; 175/48, 7

[56] References Cited

UNITED STATES PATENTS

| | | | |
|---|---|---|---|
| 2,832,566 | 4/1958 | Bielstein | 175/48 |
| 3,545,276 | 12/1970 | Parr | 73/395 |
| 3,760,891 | 9/1973 | Gadbois | 73/155 |
| 3,827,295 | 8/1974 | Rochon et al. | 73/155 |

*Primary Examiner*—Donald O. Woodiel

*Attorney, Agent, or Firm*—John S. Schneider

[57] ABSTRACT

A method is disclosed for remotely measuring the vertical height and/or density of a drilling fluid column in a marine riser. The hydrostatic pressure of the drilling fluid is measured at any point below the surface outlet of the drilling fluid in the marine riser. The distance between the surface outlet or discharge level of the drilling fluid (normally the top of the fluid column) in the riser and the level in the riser at which the presure measurement is made (bottom of the fluid column) is known because of the physical arrangement of the riser permitting conversion of the pressure measurement to density. The height of the fluid column in the riser from the bottom to the top thereof when the top of the fluid column falls below the surface outlet is determinable by using the measured fluid density just prior to the drop in the height of the fluid column.

2 Claims, 3 Drawing Figures

METHOD FOR MEASURING THE VERTICAL HEIGHT AND/OR DENSITY OF DRILLING FLUID COLUMNS

BACKGROUND OF THE INVENTION

Several methods and devices are in current use for measuring the density of drilling fluids used to drill oil and gas wells. All of these devices and methods measure only the density of fluids in surface facilities and none incorporates the capability of vertical height measurement of a fluid column in a riser.

In the method of the invention measurements of the drilling fluid density may be made with the drilling fluid in either a static or dynamic condition. Also, the height of the fluid column in the riser above a known reference level is measurable when the density of the fluid is known.

The invention has several advantages over existing methods and devices used to measure drilling fluid densities. The drilling fluid density measurements are made using a length of well bore annular drilling fluid column in either a static or dynamic state and prior to separation of any drilled solids or gas. In this manner a more realistic measurement of the density of the drilling fluid returns is provided. With the measured density of the drilling fluid, the height of the drilling fluid column above a reference point is continuously measured. Such capability can be used to locate the level of the drilling fluid column in the event of complete loss of circulation and to measure the volume of fluid needed to fill the hole when "pulling" the drill string (trip out). Marine drilling may in the future require airlift of the returns drilling fluid to prevent loss of circulation. When airlift is required, monitoring of the total hydrostatic head in the marine riser will be essential for well control. The present invention provides such capability. Any appreciable column of formation gas entering the well bore and rising to a point above the reference point in the riser will result in a reduction in the average density of the measured fluid column and therefore can be detected by the method of the present invention.

SUMMARY OF THE INVENTION

A method for measuring the density, and with that known measured density determining the vertical height, of a drilling fluid column formed in a marine riser used in offshore drilling operations in which the riser extends from a submerged wellhead to the surface of the water which comprises the steps of measuring the hydrostatic pressure of the drilling fluid column in the riser at a selected point along the length of the riser, the point being a known distance below the fluid returns outlet of the riser such that said pressure measurement at that point provides an indication of variations in drilling fluid weight and drilling fluid level in the riser. The apparatus comprises a small tube extending from above the water's surface and connected at its lower end to the riser at the point it is desired to measure the pressure of the drilling fluid column.

In one embodiment of the apparatus the tube contains a check valve, which permits flow of fluid into the riser but prevents flow of fluid from the riser into the tube, and a pressure regulator valve. Fluid in the tube at the check valve is at a pressure at or just above the pressure of the drilling fluid in the riser at the point or level of the connection of the tube to the riser. The pressure of the fluid in the tube measured at the surface provides a measurement of the fluid weight and fluid level within the riser. In another embodiment of the invention, instead of a check valve and pressure regulator valve, the tube contains a hydraulic pressure cell and is filled with fluid. The pressure of the fluid in the tube measured at the surface provides a measurement of the drilling fluid weight and fluid level within the riser.

DESCRIPTION OF THE PREFERRED EMBODIMENTS

Figures 1, 2:
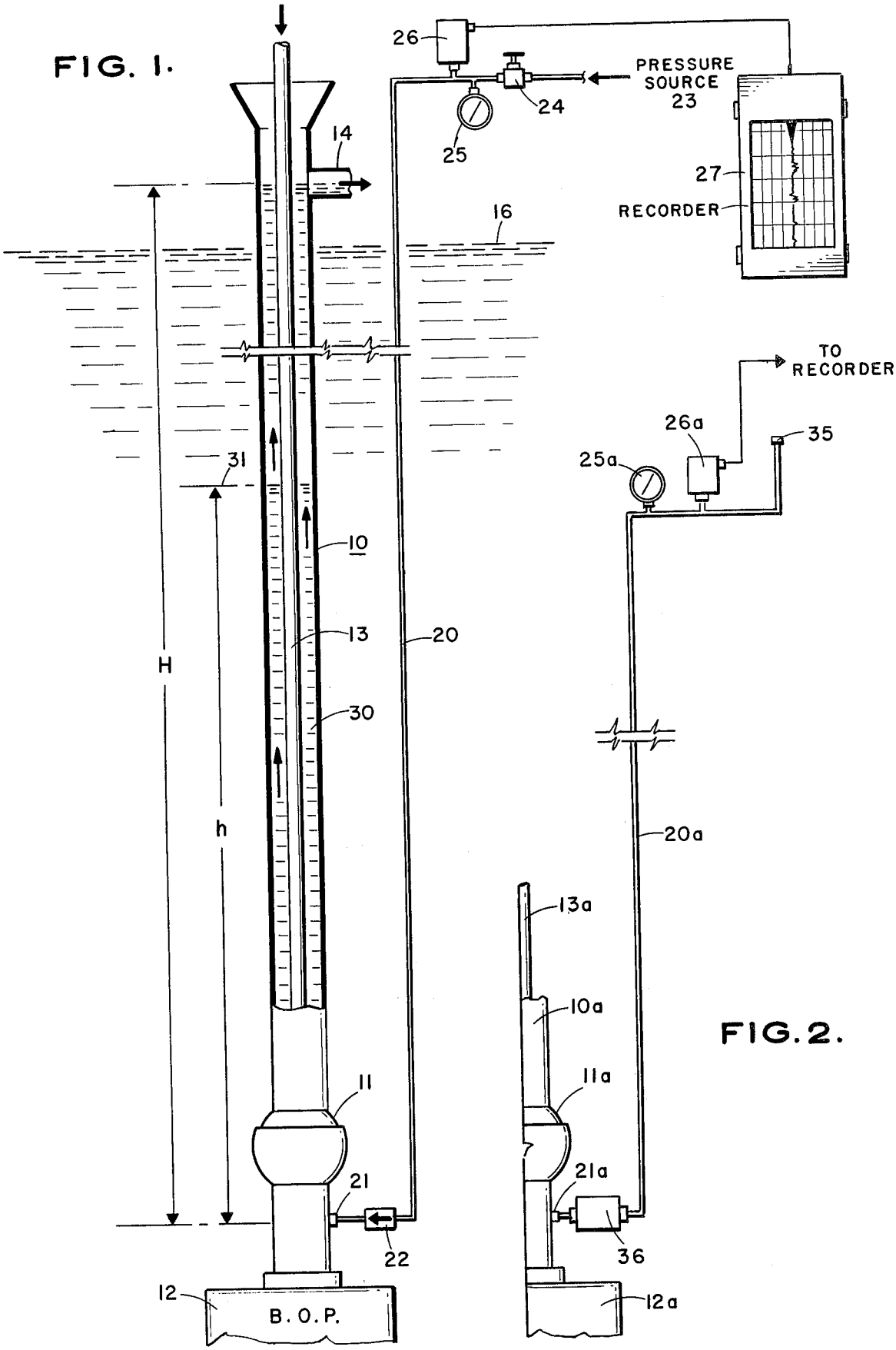
FIG. 1 is a schematic view of a marine riser with a small tube connected between the riser and a source of fluid pressure, as in one embodiment of the invention.
FIG. 2 is a schematic view of a marine riser with a small tube connected thereto containing a hydraulic pressure cell, as in another embodiment of the invention.

Referring to FIG. 1 there is shown a marine riser 10, which includes at its submerged lower end a standard ball joint 11, connected to a blowout preventer assembly 12 arranged near or on the ocean floor. A drill pipe 13 extends through riser 10 and ball joint 11 and blowout preventer 12 during drilling of a subsea well. Riser 10 is suitably suspended from the drilling vessel, not shown, and is provided with a drilling fluid returns outlet 14 above the water level 16. Although not shown the riser may also contain, as is customary, one or more flexible and/or telescopic joints to compensate for minor vertical and horizontal movements of the vessel. A small tube 20 extends from above the water's surface to the lower end of riser 10 where it is connected thereto just above blowout preventer 12 at 21. A check valve 22 is arranged in tube 20 adjacent connection 21 and prevents flow of fluids from riser 10 into tube 20 but allows fluids to flow from the tube 20 into the riser 10. Above water surface 16 tube 20 is connected to a pressure source, indicated at 23. A pressure regulator valve 24 and a pressure gauge 25 are located in tube 20 near a pressure measuring device 26, which device is, in turn, connected to a pressure recorder 27.

In a drilling operation, as indicated by the arrows, drilling fluid is circulated down drill pipe 13 and upwardly through the annulus formed by the borehole wall and drill pipe 13 and the annulus formed by riser 10 and drill pipe 13. Thus, the riser and the drill pipe form an annular flow path 30 for drilling fluid returns from the well bore to the surface drilling fluid system located on the drilling vessel.

Figure 3:
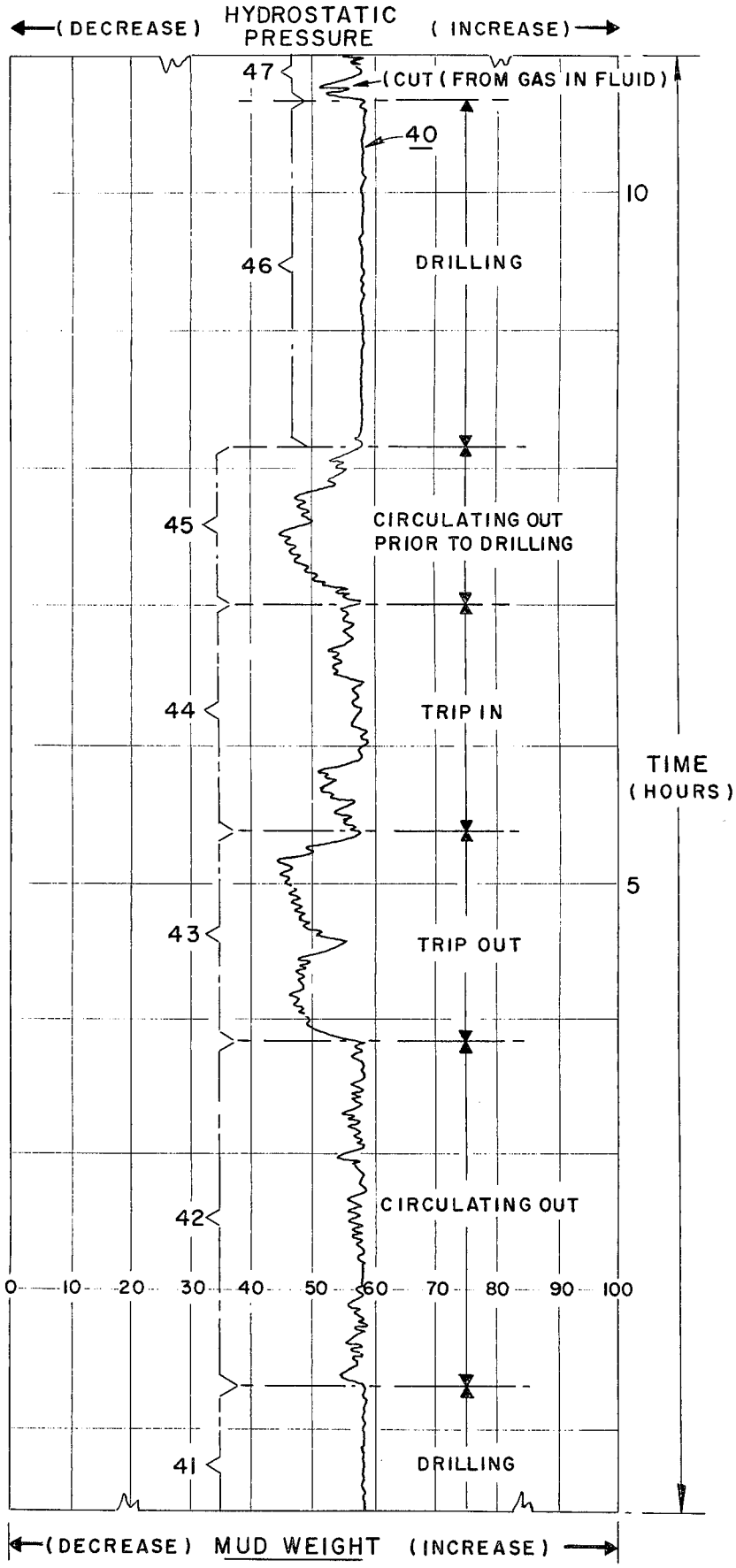
FIG. 3 is a recorded log of pressure versus time measured during actual drilling operations in accordance with the invention.

A small quantity of air, gas or other fluid of known density is introduced into tube 20 from the source 23. Pressure regulator valve 24 controls the pressure of the fluid in tube 20 which is set at or slightly above the pressure of the drilling fluid at connection point 21. Variations in fluid pressure in tube 20 is measured by pressure measuring device 26 and recorded, as indicated in FIG. 3.

It is known from the laws of physics that a column of fluid (liquid or gas) exerts a pressure in all directions which is a function of density of the fluid and height of the fluid column. Published data on pure water ($H_2O$) density (1.0) establishes a pressure of 0.433 pounds per square inch (psi) per foot of fluid column. Using such relationship and a known (measured) height of fluid column "H," the average density of any fluid in the riser can be determined by measuring the hydrostatic pressure at point 21. The fluid column of unknown density in riser 10 exerts a pressure (P) at that point.

At level 21 the fluid column of known density in tube 20 exerts a pressure of: $\rho(H) \times 0.433$ psi where $\rho =$ density or specific gravity of fluid in tube 20.

As an example, to determine density assume $\rho = 1.0$ (pure water) and H = 1000 ft. then the pressure P exerted by a water column in tube 20 equals $1.0 \times 1000 \times 0.433 = 433$ psi.

When the pressure exerted by the column of unknown density in the riser exceeds 433 psi fluid cannot flow from the surface injection point 21 into the riser 10 for the check valve 22 prevents flow from the riser (unknown fluid column) to the known fluid column in tube 20 but permits flow of fluid in the other direction.

When the pressure at the point of injection 21 is mechanically increased sufficiently to initiate movement of fluid from the tube (known fluid column) into the riser (unknown fluid column) the applied surface pressure plus 433 psi is equal to P. Assume a pressure of 87 psi is required at the surface injection point 23 to initiate movement of fluid from the tubing into the riser. Therefore, 87 psi plus 433 psi equals 520 psi at point 21.

$$\rho \text{ (unknown)} = 520 \text{ psi}/1000 \text{ ft. } (0.433)$$

$\rho$ (unknown) = 1.20; which equated to pounds per gallon equals water ($H_2O$) at 1.0 density equals 8.34 pounds per gallon.

Therefore, $8.34 \times 1.20 = 10$ pounds per gallon for the unknown fluid column.

The calculation would be similar if air (or other gas) is used instead of water (or other liquid) as the injected fluid.

The applied pressure at the surface $(P) + \rho\,(H) = P$ (subsurface); and using published density and compressibility factors for air, or other gas used, and measured applied pressure at the surface, the subsurface pressure of 520 psi and the unknown density of 1.20 or 10 pounds per gallon can be determined.

To determine the height ($h$) of the fluid column in the event of lost returns, assume that the riser fluid column is being monitored and is known to be 10 pounds per gallon when the returns are lost and the fluid level in the riser falls below the known height H, and water is being used as the injected fluid and the surface injection pressure is measured at 10 psi, then:

$$P = (H)\,(0.433) + 10 \text{ psi}$$

$$P = (1000)\,(0.433) + 10 \text{ psi} = 443 \text{ psi.}$$

With a known density of 1.20 in the marine riser:

$$433 = 1.20\,(0.433)\,(h) \text{ or}$$

$$h = 443/(1.20)\,(0.433) = 443/0.52 = 833 \text{ ft. or}$$

$$1000 \text{ ft.} - 833 \text{ ft.} = 167 \text{ ft.}$$

below the outlet level.

The measured pressure plus the hydrostatic pressure of the column of fluid in tube 20, as explained, is equal to the hydrostatic pressure of the drilling fluid column inside riser 10.

An alternative apparatus is illustrated in FIG. 2 in which riser 10*a* has connected to it a tube 20*a* which at the surface of the water is closed as at 35 after being filled with fluid. The fluid pressure is measured by the the pressure measuring device 26*a* which is connected to a recorder, not shown. A pressure gauge 25*a* is connected into tube 20*a* and a hydraulic pressure cell 36 is arranged on tube 20*a* adjacent its connection 21*a* to marine riser 10*a* adjacent ball joint 11*a* above blowout preventer 12*a*. The determination of density of the drilling fluid and the height of the fluid column in the riser in the embodiment of FIG. 2 is the same as described with respect to the embodiment of FIG. 1.

Referring to FIG. 3 a log of pressure is measured and recorded versus time (hours) in accordance with the embodiment of FIG. 1 for a typical drilling operation.

Referring to the lower end curve 40, during the period indicated at 41 the steady hydrostatic pressure of about 59 reflects drilling operations with 13 pounds per gallon mud. The slight movements of the line indicates rapid opening and closing of the check valve 22. At the interval indicated at 42 (immediately above interval 41) the drill string has been raised and fluid is being circulated through the drill pipe and drill bit and up the annulus and out the riser discharge. During this circulation operation some gas from the subsurface formations enters the drilling fluid as evidenced by reduction in the hydrostatic pressure of the drilling fluid. During the interval "trip out", indicated at 43, the drill pipe is being pulled. A greater reduction in hydrostatic pressure of the drilling mud is shown during that operation. Similarly, during the "trip in" period indicated at 44, (in which the drill pipe is being run back into the borehole) the hydrostatic pressure of the drilling mud is reduced but not quite to the extent shown for the trip-out operation. During the period indicated at 45 the drilling mud is being circulated out prior to drilling and again a greater reduction in hydrostatic pressure is shown. During the period indicated at 46 the drilling operation is resumed at the same hydrostatic pressure, 59, and mud weight as the drilling operation shown for the drilling period 41. The interval designated 47 shows a reduction in the hydrostatic pressure and indicates that the drill bit has cut into a gas formation during drilling and the hydrostatic pressure of the drilling fluid in the riser is reduced by gas entering the drilling fluid from that formation.

In operation on a floating drilling the small tube is generally available from a spare pilot tube in the blowout preventer hydraulic control hose bundle. High pressure air (up to 3000 psi) is also available on many floating drilling vessels from the riser tensioning system. Thus, the invention is readily installed on many floating rigs at nominal cost. The equipment described above for making and practicing the invention, including the check valve, pressure regulator, pressure measuring device, pressure cell and recorder, is conventional, commercially available equipment.

The term drilling fluid as used herein includes any drilling mud system useful in drilling wells and particularly oil and/or gas wells.

Changes and modifications may be made in the illustrative embodiments of the invention shown and/or described herein without departing from the scope of the invention as defined in the appended claims.

Having fully described the apparatus, method of operation, advantages and object of my invention I claim:

1. A method for measuring the vertical height of a drilling mud column formed in a riser pipe during offshore drilling operations in which said riser pipe extends from adjacent the sea floor to the surface of the water and said mud column is formed in said riser by drilling mud which is pumped down the drill pipe and up the annulus between the drill pipe and the riser during such drilling operations comprising the steps of:

remotely determining at the surface of the water the pressure of the drilling mud column in the riser at a level below the drilling mud returns outlet;

said drilling mud column pressure being convertible to the vertical height of the drilling mud column in said riser above said level;

said pressure determinations being made by injecting liquid through a tube which extends from above the surface to the pressure determining level of said drilling mud column at a pressure which when added to the hydrostatic pressure of the liquid in said tube at said level is about the same as the pressure of said drilling mud column at said level, said pressure determinations being recorded versus time.

2. A method for measuring the vertical height of a drilling mud column formed in a riser pipe during offshore drilling operations in which said riser pipe extends from adjacent the sea floor to the surface of the water and said mud column is formed in said riser by drilling mud which is pumped down the drill pipe and up the annulus between the drill pipe and the riser during said drilling operations comprising the steps of:

remotely determining at the surface of the water the pressure of the drilling mud column in the riser at a level below the drilling mud return outlet;

said drilling mud column pressure being convertible to the vertical height of the drilling mud column in said riser above said level;

said pressure determinations being made by measuring the pressure of fluid in a tube which extends from above the surface to the pressure determining level of said drilling mud column and contains a pressure cell between said riser drilling mud and tube fluid, said pressure determinations being recorded versus time.

* * * * *